US007841595B2

(12) United States Patent
Massoud et al.

(10) Patent No.: US 7,841,595 B2
(45) Date of Patent: Nov. 30, 2010

(54) METHOD AND DEVICE FOR FEEDING PRINTED PRODUCTS USING ALTERNATING ACCELERATION AND DECELERATION PHASES

(75) Inventors: Atef Tanious Massoud, Nottingham, NH (US); Mehmet Oktay Kaya, Lee, NH (US); Juan Rolando Antezana, New Market, NH (US); John Allan Manley, Brentwood, NH (US)

(73) Assignee: Goss International Americas, Inc., Durham, NH (US)

( * ) Notice: Subject to any disclaimer, the term of this patent is extended or adjusted under 35 U.S.C. 154(b) by 342 days.

(21) Appl. No.: 11/154,751

(22) Filed: Jun. 16, 2005

(65) Prior Publication Data

US 2005/0285321 A1 Dec. 29, 2005

Related U.S. Application Data

(60) Provisional application No. 60/582,565, filed on Jun. 24, 2004.

(51) Int. Cl.
*B65H 5/34* (2006.01)

(52) U.S. Cl. ..... 271/270; 271/11; 271/100

(58) Field of Classification Search ..... 271/10.01, 271/11, 100, 107, 277, 270
See application file for complete search history.

(56) References Cited

U.S. PATENT DOCUMENTS

| | | | | | |
|---|---|---|---|---|---|
| 3,960,079 | A | * | 6/1976 | Capetti | 101/232 |
| 4,132,403 | A | * | 1/1979 | Weisbach et al. | 271/277 |
| 4,252,307 | A | * | 2/1981 | Korte | 271/4.01 |
| 4,290,595 | A | * | 9/1981 | Thunker | 271/277 |
| 4,358,100 | A | * | 11/1982 | Muller | 271/11 |
| 4,491,311 | A | * | 1/1985 | Glanzmann | 270/52.27 |
| 4,976,420 | A | * | 12/1990 | Flensburg et al. | 270/52.28 |
| 4,993,702 | A | * | 2/1991 | Jackson | 271/270 |
| 4,993,703 | A | | 2/1991 | Sears | |
| 5,411,250 | A | | 5/1995 | Belec et al. | 271/185 |
| 5,452,886 | A | * | 9/1995 | Cote et al. | 271/270 |
| 5,560,599 | A | * | 10/1996 | Curley et al. | 271/270 |
| 5,649,483 | A | * | 7/1997 | Mack et al. | 101/232 |
| 5,794,929 | A | * | 8/1998 | Curley et al. | 271/270 |
| 6,070,866 | A | * | 6/2000 | Wepfer | 271/10.11 |

(Continued)

FOREIGN PATENT DOCUMENTS

DE 43 09 888 A1 9/1994

(Continued)

OTHER PUBLICATIONS

Product Information on Heidelberger Druckmaschinen AG saddle stitcher ST-400 print-out of Sep. 9, 2005 from www.heidelberg.com.

*Primary Examiner*—Gene Crawford
*Assistant Examiner*—Gerald W McClain
(74) *Attorney, Agent, or Firm*—Davidson, Davidson & Kappel, LLC

(57) ABSTRACT

A first embodiment of the present invention provides a method for transferring printed products and comprises the steps of pulling a printed product from a stack using a feed device running at a first preselected speed, accelerating the feed device after pulling the printed product from the stack and releasing the printed product from the feed device at a second preselected speed greater than the first speed.

24 Claims, 18 Drawing Sheets

U.S. PATENT DOCUMENTS

| | | | | |
|---|---|---|---|---|
| 6,082,724 | A * | 7/2000 | Kahlig et al. | 270/52.14 |
| 6,193,229 | B1 | 2/2001 | Hall et al. | |
| 6,224,050 | B1 | 5/2001 | Wicki | |
| 6,308,945 | B1 * | 10/2001 | Sagesser | 270/52.27 |
| 6,623,000 | B2 * | 9/2003 | Hall | 271/11 |

FOREIGN PATENT DOCUMENTS

| | | |
|---|---|---|
| JP | 59-207359 | 11/1984 |
| JP | 63-115963 | 5/1988 |
| JP | 4-269594 | 9/1992 |
| JP | 07-61676 | 3/1995 |
| JP | 10-291664 | 11/1998 |

* cited by examiner

METHOD AND DEVICE FOR FEEDING PRINTED PRODUCTS USING ALTERNATING ACCELERATION AND DECELERATION PHASES

This claims the benefit of U.S. Provisional Patent Application No. 60/582,565, filed Jun. 24, 2004, which is hereby incorporated herein.

BACKGROUND OF THE INVENTION

The present invention is directed to a method and device for feeding printed products, for example from a stack using a feeding device such as a gripper drum.

U.S. Pat. No. 6,082,724 describes a variable speed sheet material assembly apparatus with a feed mechanism driven by a feed motor, and is hereby incorporated by reference herein. Sheet material articles are delivered from the feed mechanism to moving pockets of a pocket conveyor driven by a conveyor drive motor. The feed motor operating speed is varied as a function of the conveyor drive motor to coordinate the relative speeds of the feed motor and the conveyor drive motor for proper delivery of the sheet materials from the feed mechanism to the pockets of the pocket conveyor.

Feeding devices comprising rotating drums for hoppers typically run at a constant speed over the entire 360 degrees of rotation. The feed drum is operated at a rotational speed that is sufficiently slow to avoid tearing of the printed product or other malfunctions. For example, it has been known to run the feed drum at half the speed of the conveyor, as a safer operational speed for the feed drum is often more limited than a speed feasible for a conveyor. However, twice as many feed drums are then required to collect a product of a certain size, and the set up time can become a longer and more complex operation due to a speed mismatch between the rotating feed drum and the conveyor.

SUMMARY OF THE INVENTION

The present invention provides a method and device for feeding printed products in a manner so as to reduce errors related to the transfer of printed products from a stack to a conveyor.

According to a first exemplary embodiment of the present invention, a method for transferring printed products comprises the steps of pulling a printed product from a stack using a feed device running at a first preselected speed, accelerating the feed device after pulling the printed product from the stack and releasing the printed product from the feed device at a second preselected speed greater than the first speed.

According to a second exemplary embodiment of the present invention, a method for transferring printed products comprises the steps of pulling a printed product from a stack using a feed device running at a first preselected speed, accelerating the feed device after pulling the printed product from the stack to a maximum speed, releasing the printed product from the feed device while the feed device is at a second preselected speed greater than the first speed, and decelerating the feed device to the first preselected speed for pulling a next printed product from the stack.

According to a third exemplary embodiment of the present invention, a device for feeding printed products from a stack to a conveyor comprises a feed device for pulling a printed product from a stack at a first location and releasing the printed product at a second location, and a variable-speed drive for driving the feed device so as to accelerate the feed device between the first and second locations.

According to a fourth exemplary embodiment of the present invention, a method for transferring printed products between a stack and a conveyor comprises the steps of pulling a printed product from the stack using a feed device running at a first preselected speed, accelerating the feed device after pulling the printed product from the stack to a maximum speed, releasing the printed product from the feed device to the conveyor, while the feed device is at a second preselected speed greater than the first speed, and decelerating the feed device to the first preselected speed for pulling a next printed product from the stack. Pursuant to a feature of the method of this exemplary embodiment of the present invention, the feed device is operated at an average speed over acceleration and deceleration, between pulling a printed product from the stack and pulling a next printed product from the stack, such that release of each printed product is in a preselected synchronization to operation of the conveyor.

DETAILED DESCRIPTION OF THE PREFERRED EMBODIMENTS

Figure 1:
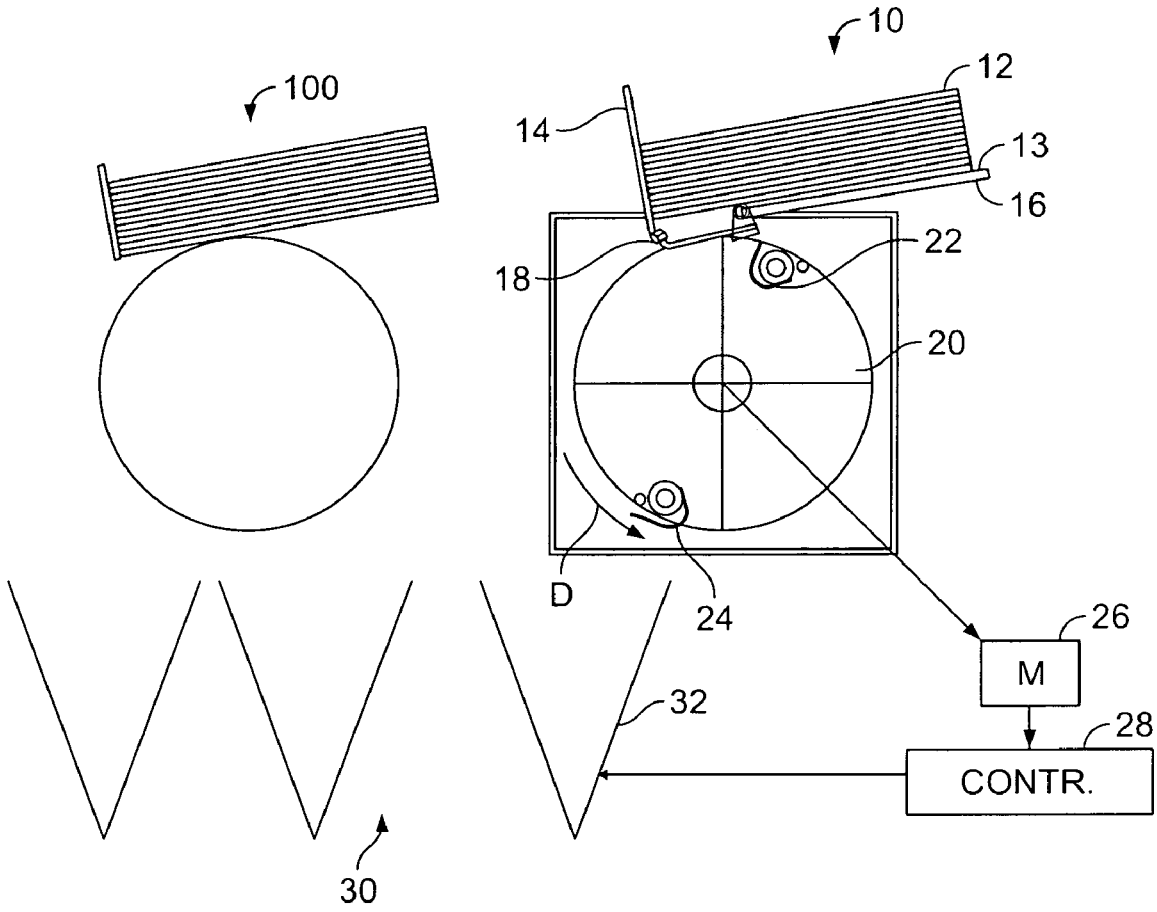
FIG. 1 shows a hopper, gripper drum and pocket conveyor arrangement according to an exemplary embodiment of the present invention.

Referring now to the drawings, and initially to FIG. 1, there is illustrated a hopper, a feed device comprising a gripper drum and a pocket conveyor arrangement according to an exemplary embodiment of the present invention. The arrangement comprises a first hopper 10 and a second hopper 100. The first hopper 10 has a printed product stack 12 supported by a front wall 14 and a bottom wall 16. A sucker 18 is rotatable to grip a bottom printed product 13 of the stack 12 and move it toward a printed product feed device such as a gripper drum 20. The printed product feed device can also comprise a feed chain or belt. The gripper drum 20 includes a first gripper 22 and a second gripper 24 and rotates in a direction D. The arrangement of the hopper 10, gripper drum 20 and sucker 18 is generally known in the related art.

Pursuant to a feature of the present invention, a variable speed motor M, for example, a servomotor 26, is arranged to control the rotational speed of the gripper drum 20 within a 360 degree rotation. However the drive for the drum 20 could be any type of electrical, mechanical, hydraulic or pneumatic system, for example, which permits a controllable varying speed profile for the drum 20. Motor M may be controlled for example by a controller 28. The controller 28 can also control the speed of a conveyor 30, in this embodiment a pocket conveyor having a plurality of pockets 32, as is also generally known in the related art. The printed products from a plurality of hoppers, such as hoppers 10, 100, may be collected into the pockets 32 of the pocket conveyor 30, to form, for example, newspapers or books. The arrangement of the second hopper 100 may be similar to the first hopper 10.

Figure 2:
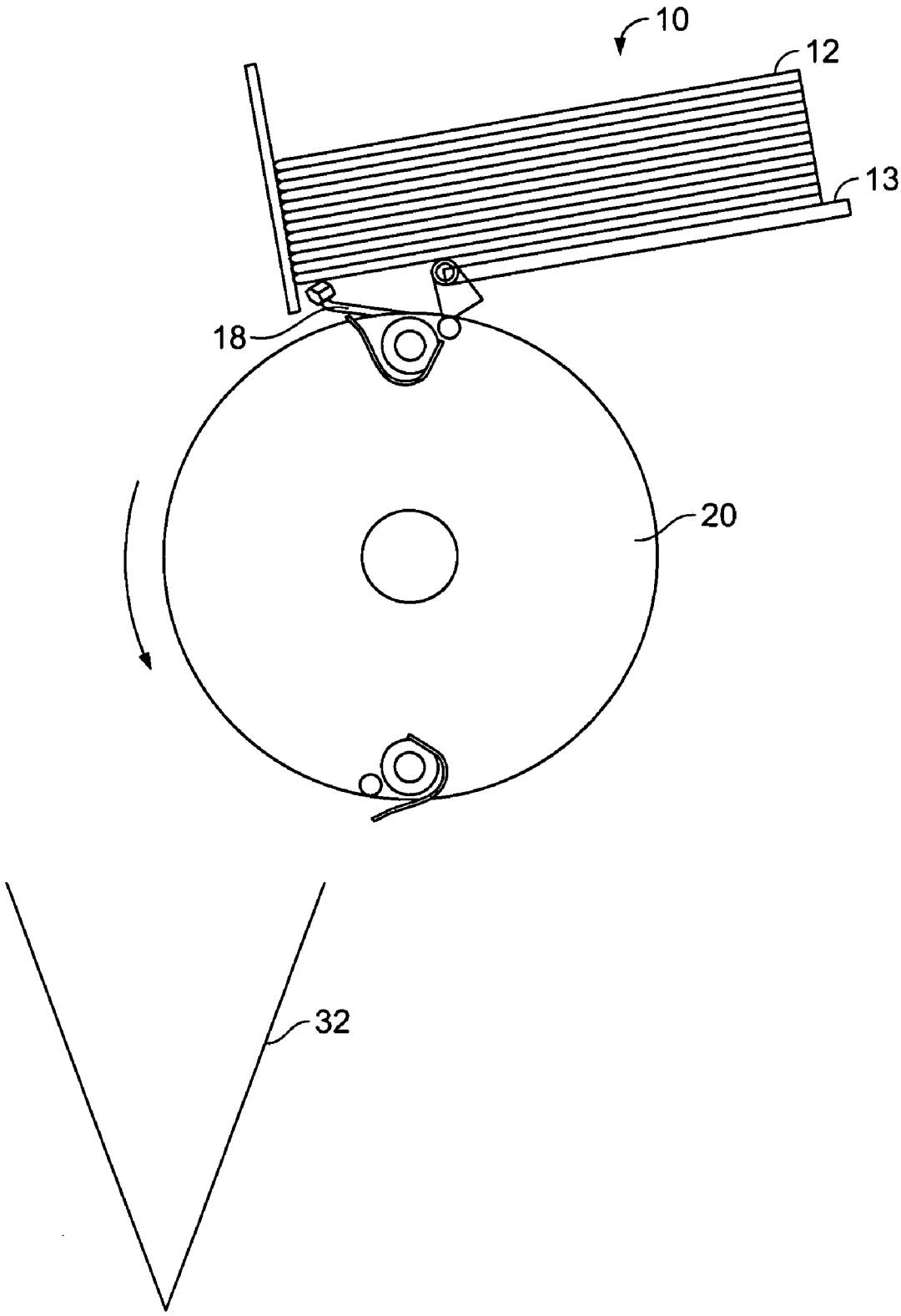
FIG. 2 shows a sucker of a hopper of the arrangement of FIG. 1, the sucker pulling down a printed product from a stack.

FIG. 2 shows the sucker 18 of the hopper 10 operating to contact the bottom printed product 13 from the stack 12.

Figure 3:
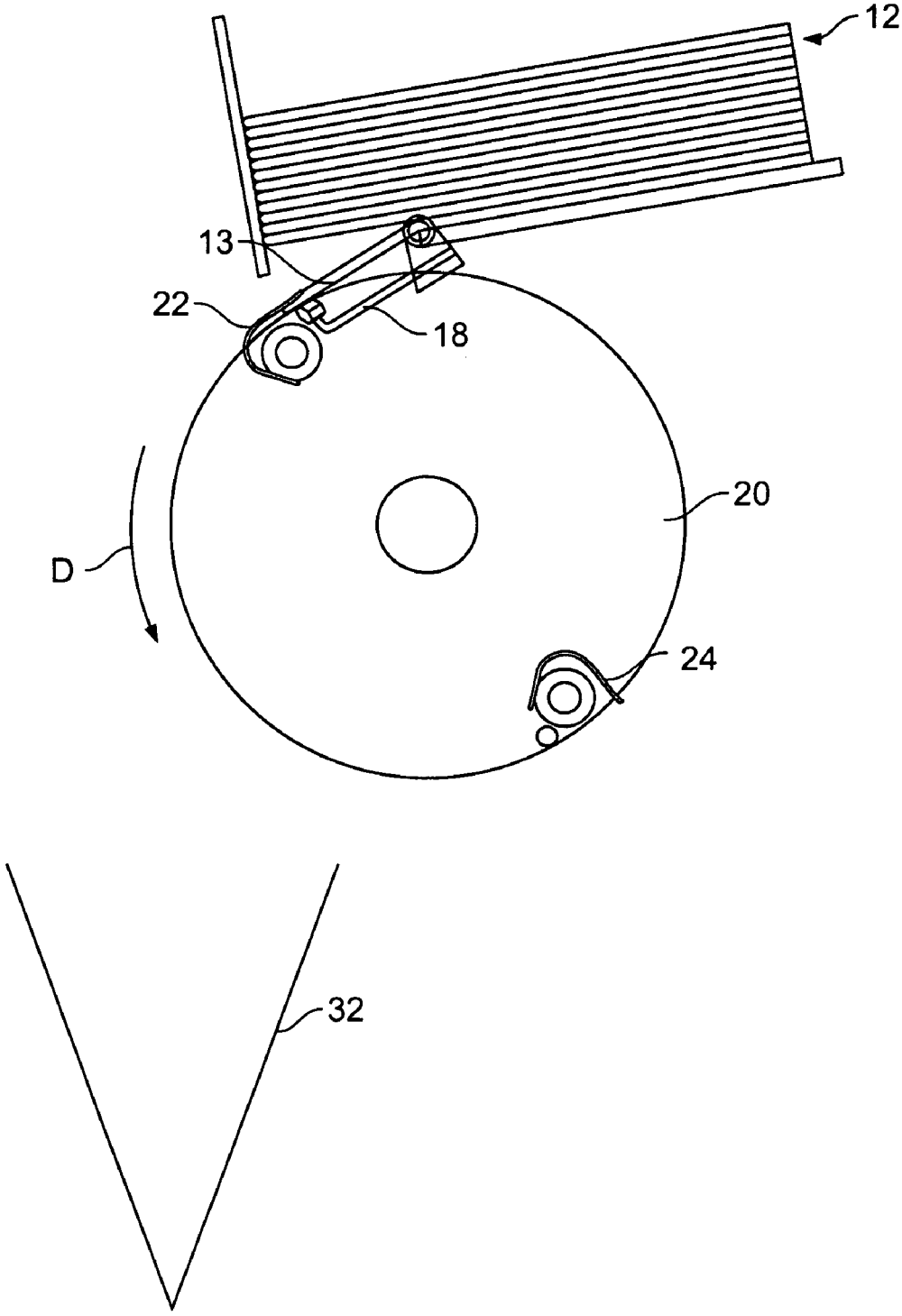
FIG. 3 shows a gripper of the gripper drum of FIG. 1, the gripper gripping the lead edge of a bottom printed product of a stack.

FIG. 3 shows the gripper 22 gripping the lead edge of the bottom printed product 13 as it is moved from the stack 12 due to the rotation of the sucker 18. According to a feature of the present invention, once the product 13 is gripped by the gripper 22, the motor M can be controlled by the controller 28 to drive and accelerate the speed of the drum 20.

Figure 4:
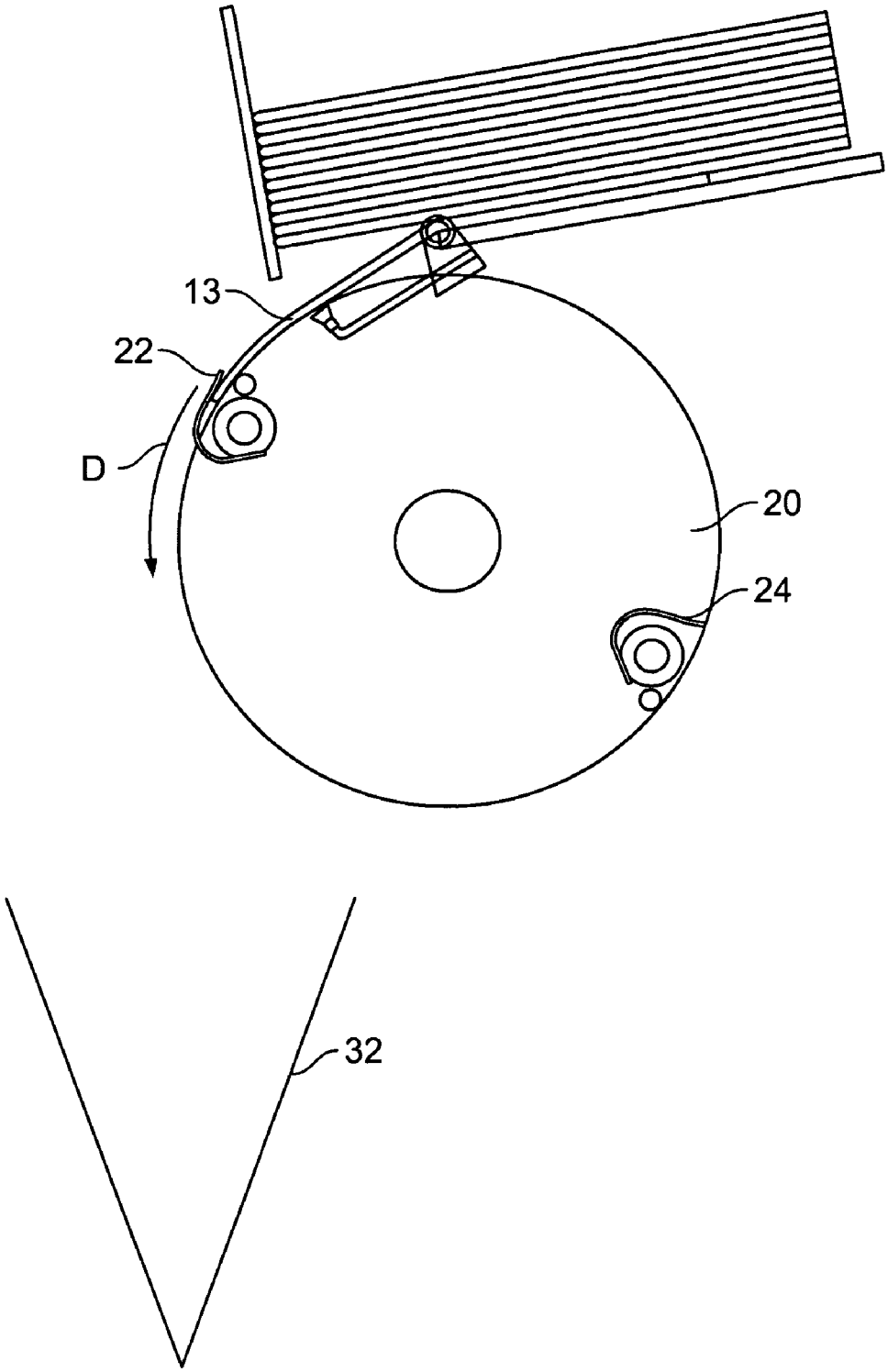
FIG. 4 shows the gripper of FIG. 3, the gripped printed product being pulled from the stack by rotation of the gripper drum, the gripper drum rotation being accelerated according to an exemplary embodiment of the present invention.

Referring to FIG. 4, the gripped printed product 13 is pulled from the stack 12 by the gripper 22, while, according to a feature of the present invention, the gripper drum 20 continues to be accelerated by the motor M.

Figure 5:
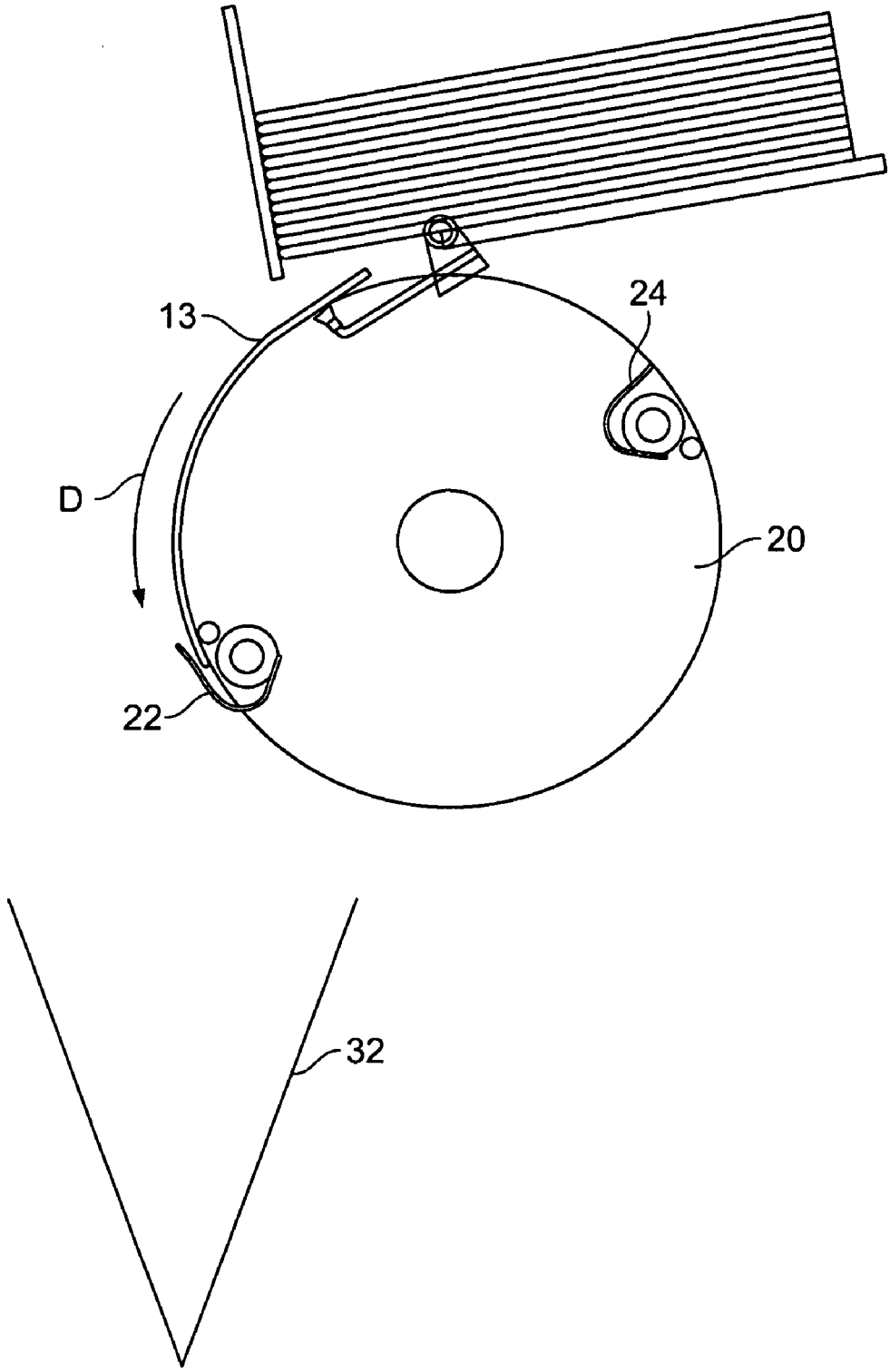
FIG. 5 shows the gripper of FIG. 3, with the gripped product on the gripper drum, and the gripper drum being accelerated according to an exemplary embodiment of the present invention.
Figure 6:
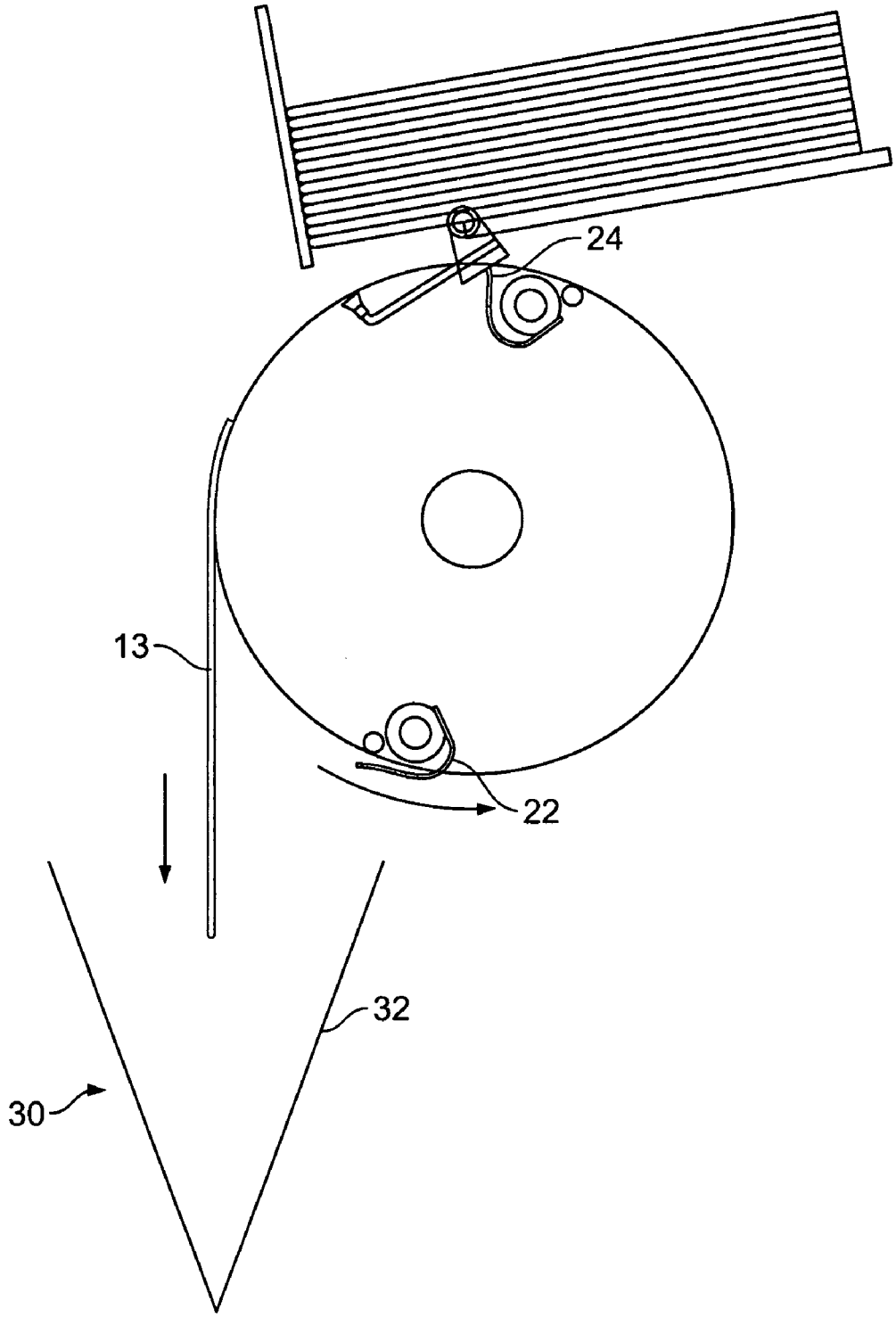
FIG. 6 shows the gripper of FIG. 3, with the gripped product being released into a pocket of the pocket conveyor.

Continuing to the illustration of FIG. 5, the gripped product 13 is pulled onto the gripper drum 20, due to the continued rotation of the gripper drum 20, with the gripper drum 20 being accelerated by motor M. FIG. 6 shows the printed product 13 being released by the gripper 22 into a pocket 32 of the pocket conveyor 30.

Figure 7:
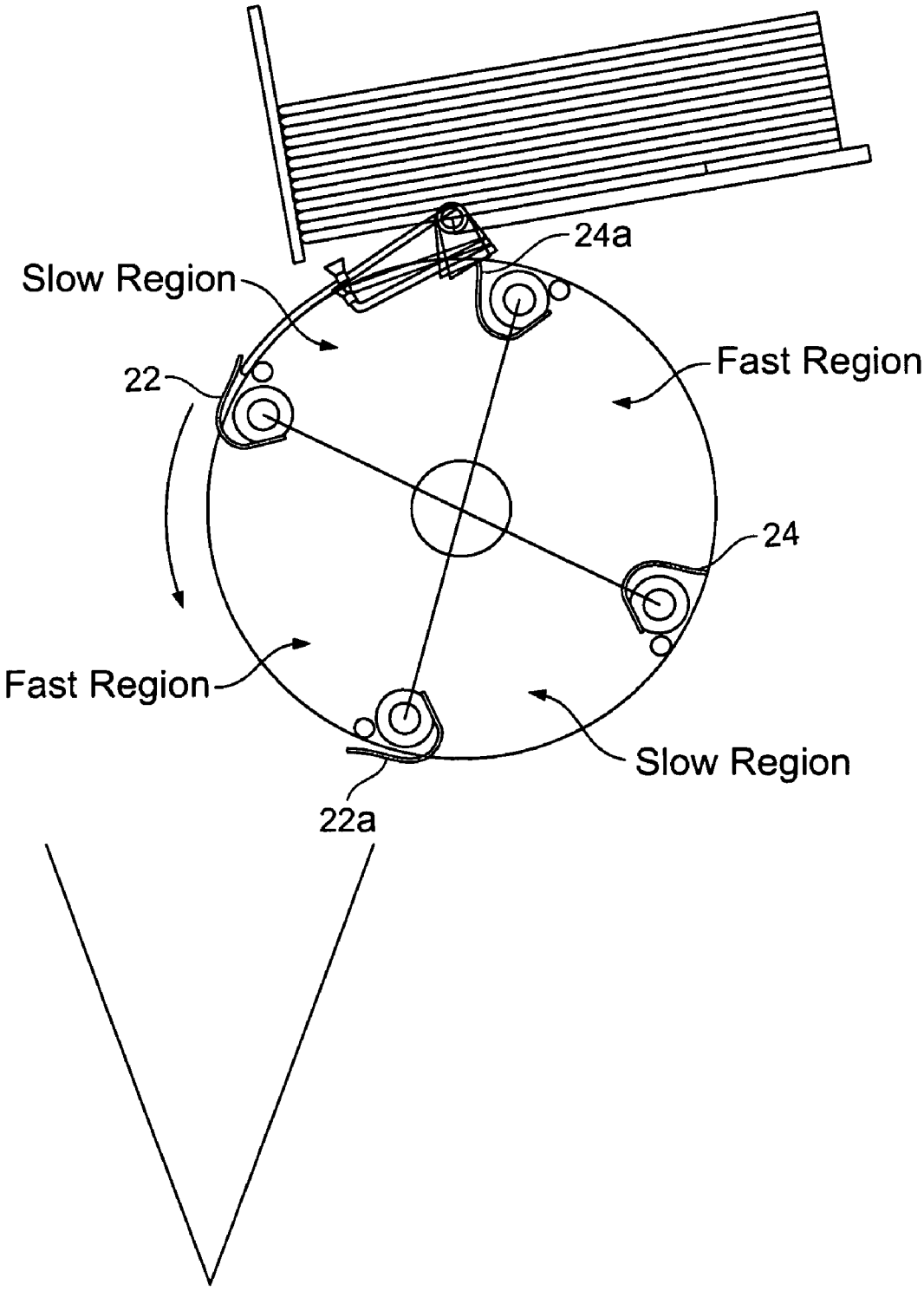
FIG. 7 is a schematic illustration of relatively slow and fast speed regions of a variable velocity profile for the gripper drum, according to an exemplary embodiment of the present invention.

FIG. 7 is a schematic illustration of relatively slow and fast speed regions of a variable velocity profile for the gripper drum 20, according to an exemplary embodiment of the present invention. Positions 22*a* and 24*a* indicate where the grippers 22, 24 enter a slow region of rotation of the gripper drum 20. A slow region is a region of the rotation of the gripper drum 20 where the speed of the gripper drum 20 is slower than the average speed during an entire rotation of the gripper drum 20. A fast region is a region of the rotation of the gripper drum 20 where the speed of the gripper drum 20 is faster than the average speed during an entire rotation of the gripper drum 20.

By permitting the printed products, such as the printed product 13, to be pulled from the stack 12 at a lower speed (a slow region of rotation) than the speed at which the printed product is released into a pocket 32 (a fast region of rotation), deficiencies such as printed product tears, insufficient separation and pulling time, a misfeed, multiple feeds and rollover of subsequent products in the stack, can be reduced.

According to the exemplary embodiment of the present invention illustrated in FIGS. 1-6, the gripper drum 20 can be rotated at various velocity profiles. For example, for a collecting apparatus running at, for example, a top speed of 30,000 products per hour (pph), the drum would run at 250 rpm if each of the two grippers 22, 24 is delivering a product to each successive pocket 32. In other words, 500 products are delivered each minute. Thus, the time for the drum 20 to make a complete revolution is 240 ms, and the time for one product is 120 ms. It is also possible for the drum 20 to only use one of the grippers 22, 24 to deliver a product to every other pocket 32. In this case, the conveyor 30 may run at the same speed and two hoppers 10, 100 are used for alternating pockets 32. It is also possible for the drum 20 to use two grippers 22, 24 and still deliver a product to only every other pocket 32, in which case the speed requirements for the hoppers are halved.

Figure 8:
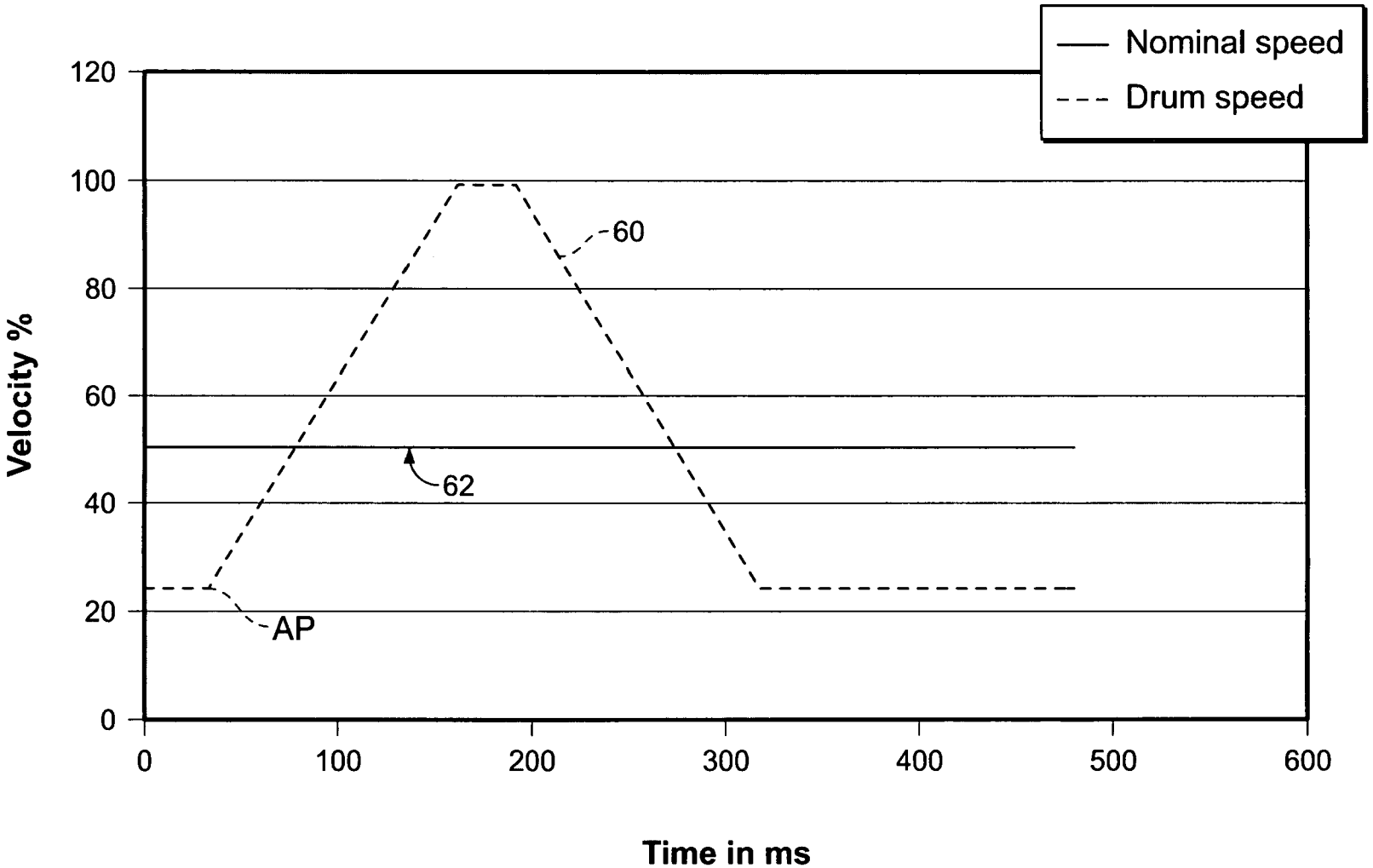
FIG. 8 shows a graphical illustration of an exemplary velocity profile for a gripper drum using one gripper feeding every other pocket of a pocket conveyor, according to a preferred embodiment of the present invention.

FIG. 8 shows an exemplary velocity profile 60 for a gripper drum 20 using one gripper 22 feeding every other pocket 32, of a pocket conveyor 30 at a collecting apparatus speed of 15,000 pph. The profile illustrates the velocity as a percentage of the top speed of the drum 20. The nominal speed 62 is the average speed of the drum 20, in this case 125 rpm, or 50% of the top speed, needed for the collecting apparatus speed. The time for a complete revolution is 480 ms. In this profile, shown by the double lines 60, the drum 20 is at a slow speed during suction, for 144 degrees and 192 ms, accelerates for 96 degrees or 128 ms to a fast speed (100%), is at the fast speed (here 250 rpm) for 24 degrees and 32 ms, and then decelerates for 128 ms back to the slow speed. The acceleration point AP can coincide with the gripping of the printed product 13, and the product may be released during a fast region of rotation to coordinate between the speeds of the pocket conveyor 30 and the drums 20 for accurate delivery of the printed product 13 by the rotating gripper drum 20 to a pocket 32 of the conveyor 30. This minimizes set up difficulties attributed to a speed mismatch between the drum 20 and conveyor 30, as encountered in previously known designs, as discussed above.

Pursuant to a feature of the present invention, the speed at which the printed product 13 is gripped by the gripper 22 is slower than average speed of the gripper drum 20, and thus, tearing and other transfer-related errors can be reduced.

Figure 9:
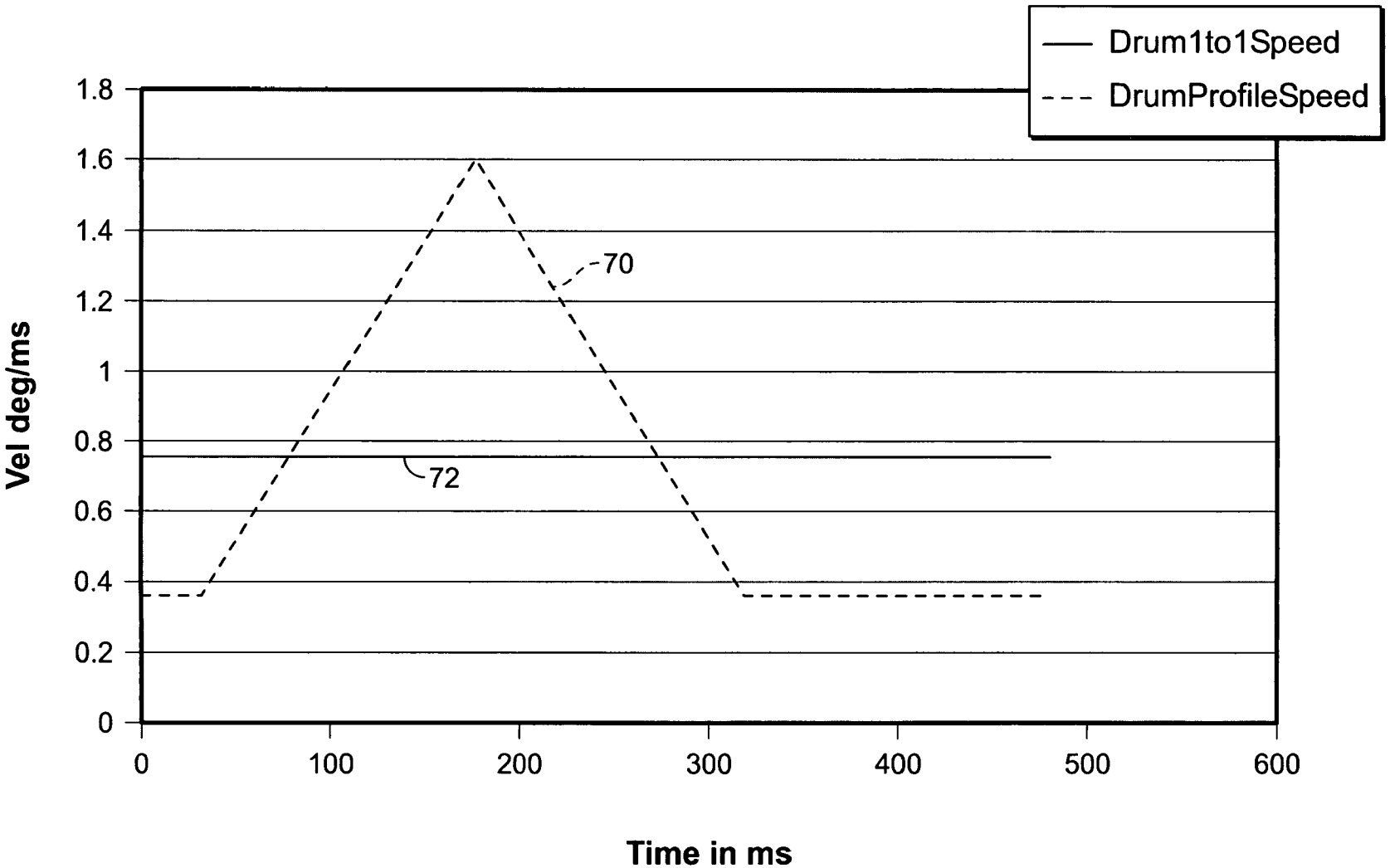
FIG. 9 shows a graphical illustration of an exemplary velocity profile for a gripper drum using one gripper feeding every other pocket according to another preferred embodiment of the present invention.
Figure 10:
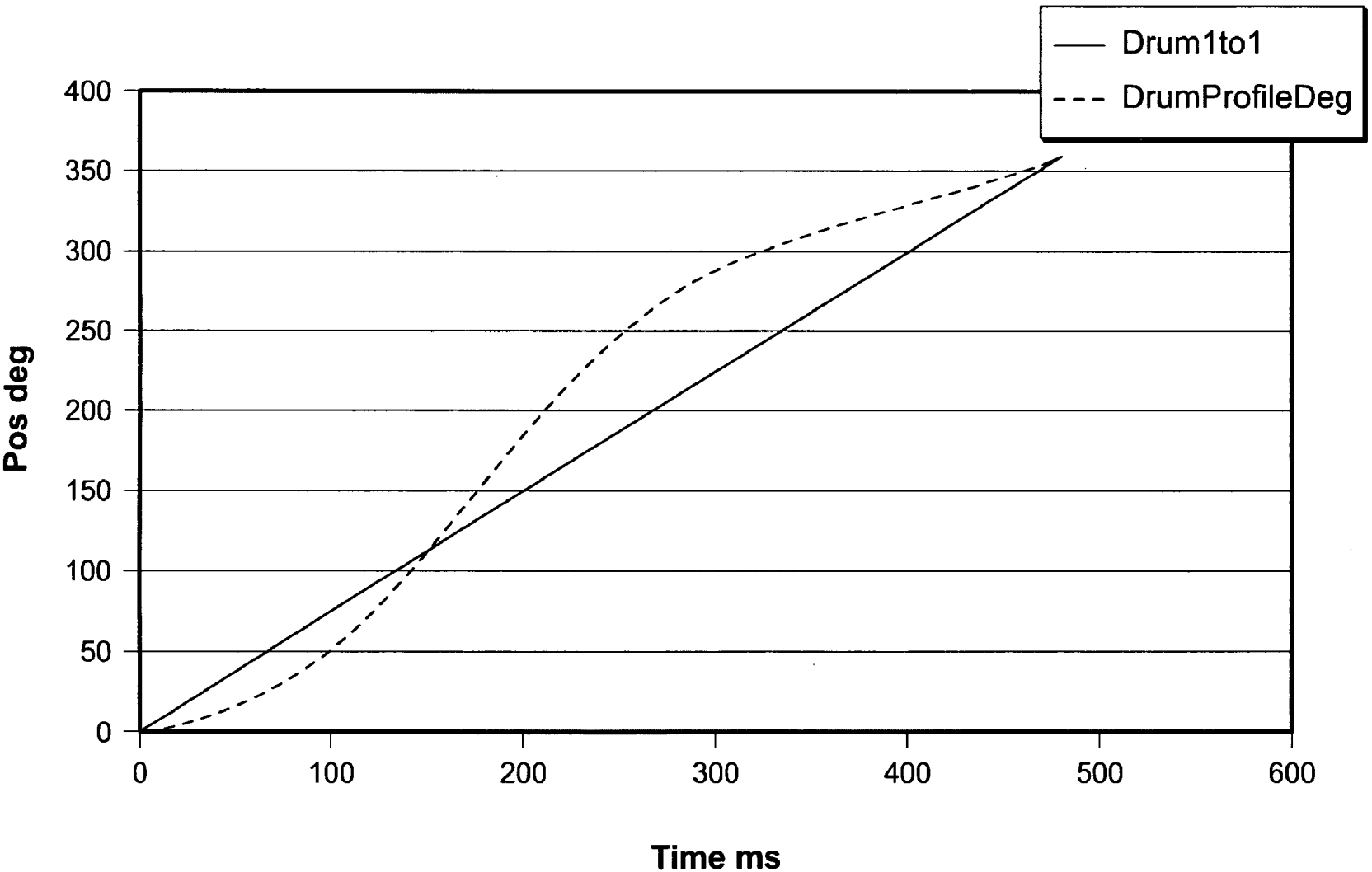
FIG. 10 shows a position profile for the velocity profile of FIG. 9.

FIG. 9 shows another exemplary velocity profile 70 for a gripper drum 20 using one gripper feeding every other pocket as in FIG. 8. The velocity is expressed in degrees/ms, but again the average single line speed 72 is at 50% or 125 rpm (0.75 degrees/ms*60000 ms/min divided by 360 degrees/revolution). Here the drum 20 is again at a slow speed for 192 ms, but accelerates for 144 ms (108 degrees) and then decelerates again for 144 ms (108 degrees). FIG. 10 shows a graph plotting the related positional movement for the drum 20 during the velocity profile of FIG. 9. In the graph of FIG. 10, the position of the drum 20, in degrees of the 360 degree rotation, is illustrated by a double line, and is plotted against elapsed time of the rotation in ms. The single line indicates the position the drum 20 would have if driven at the average single line speed 72 shown in FIG. 9.

Figure 11:
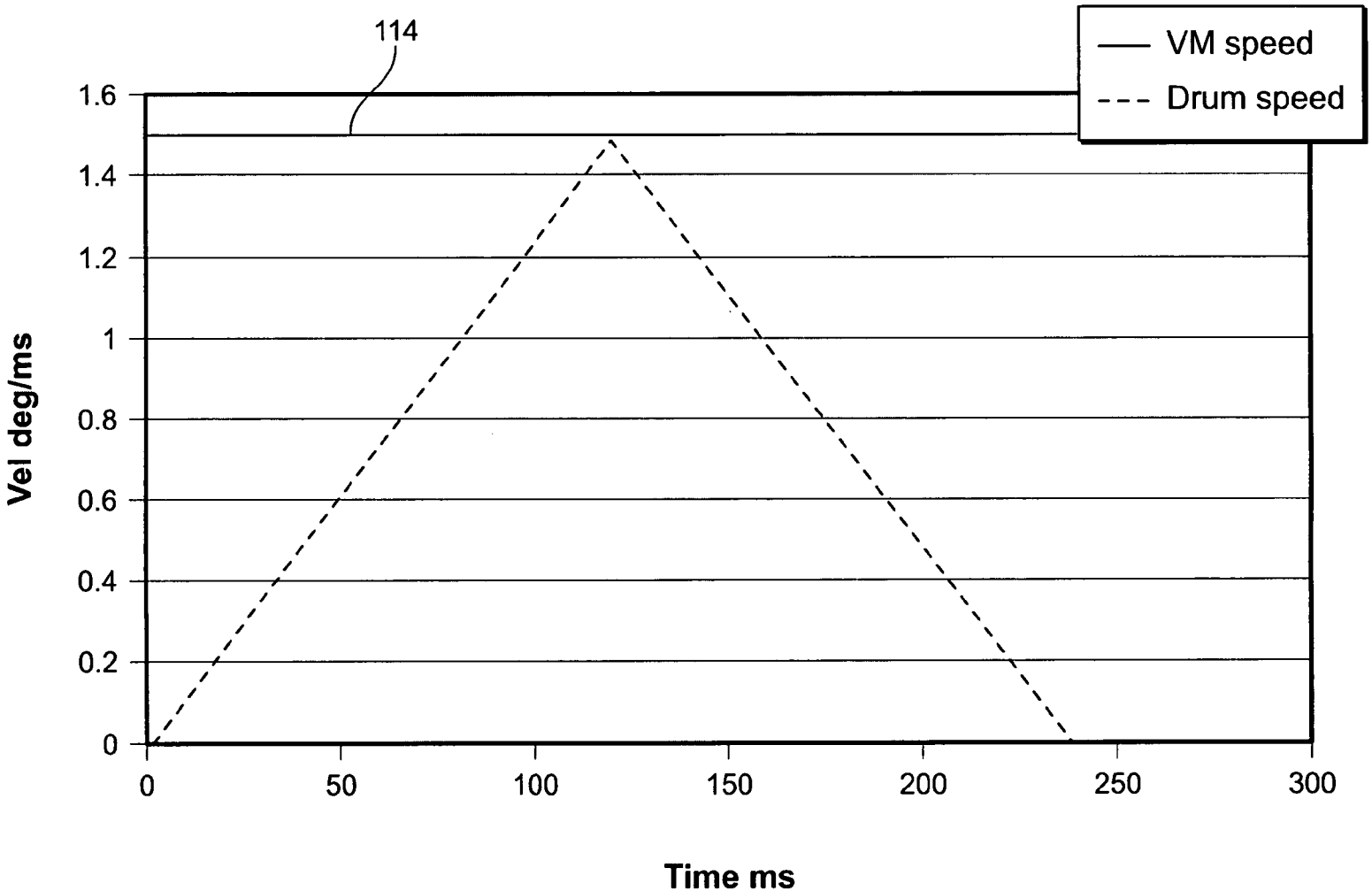
FIG. 11 shows a graphical illustration of an exemplary velocity profile for a gripper drum using one gripper feeding every other pocket according to a still further preferred embodiment of the present invention.
Figure 12:
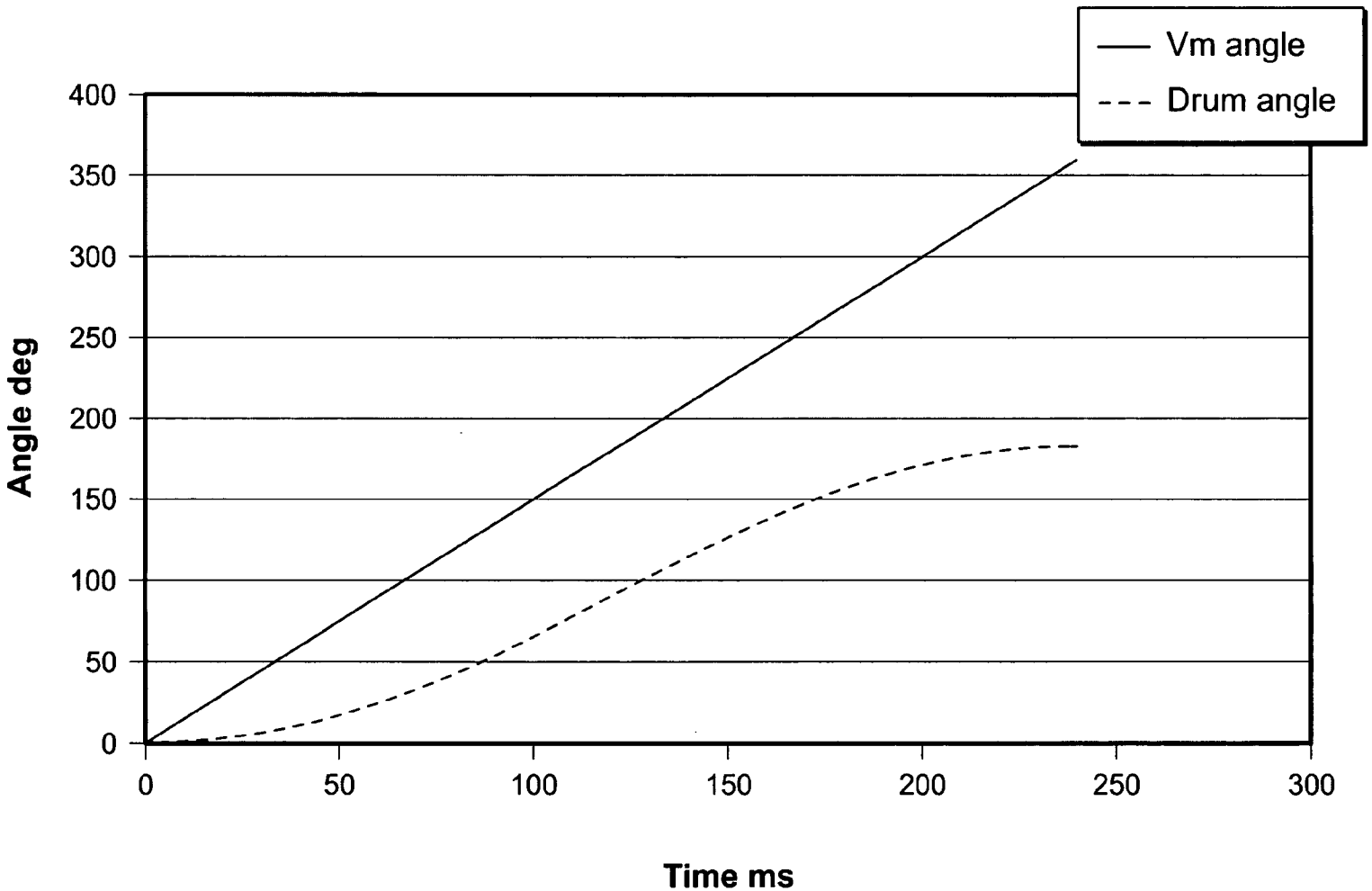
FIG. 12 shows a position profile for the velocity profile of FIG. 11.

FIG. 11 shows a further exemplary velocity profile for a gripper drum 20 using one gripper 22 to feed every other pocket 32 of the conveyor 30. FIG. 11 illustrates half a revolution of the drum 20, occurring in 240 ms. The drum 20 is run from zero to a speed Vm (250 rpm) and back again in 240 ms. The average speed of the conveyor is thus again 15,000 pph. This velocity profile produces high torque fluctuations, and thus may be less advantageous than the velocity profiles illustrated in FIGS. 9 and 10. FIG. 12 shows the positional angle of the drum 20 using the velocity profile of FIG. 11 as opposed to when the drum is run at 250 rpm, i.e. Vm.

Figure 13:
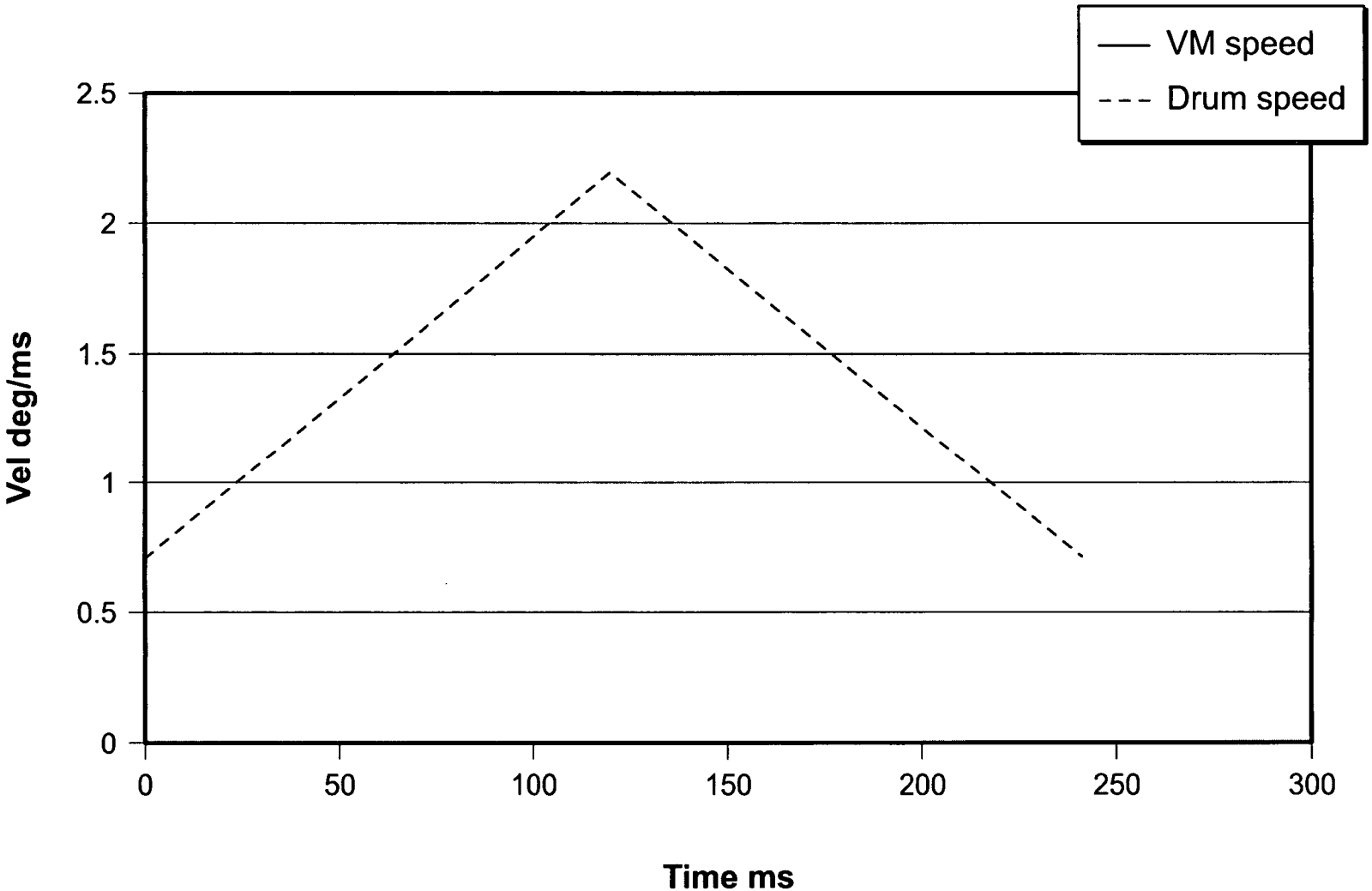
FIG. 13 shows a graphical illustration of an exemplary velocity profile for a gripper drum using one gripper feeding every other pocket at a higher speed.
Figure 14:
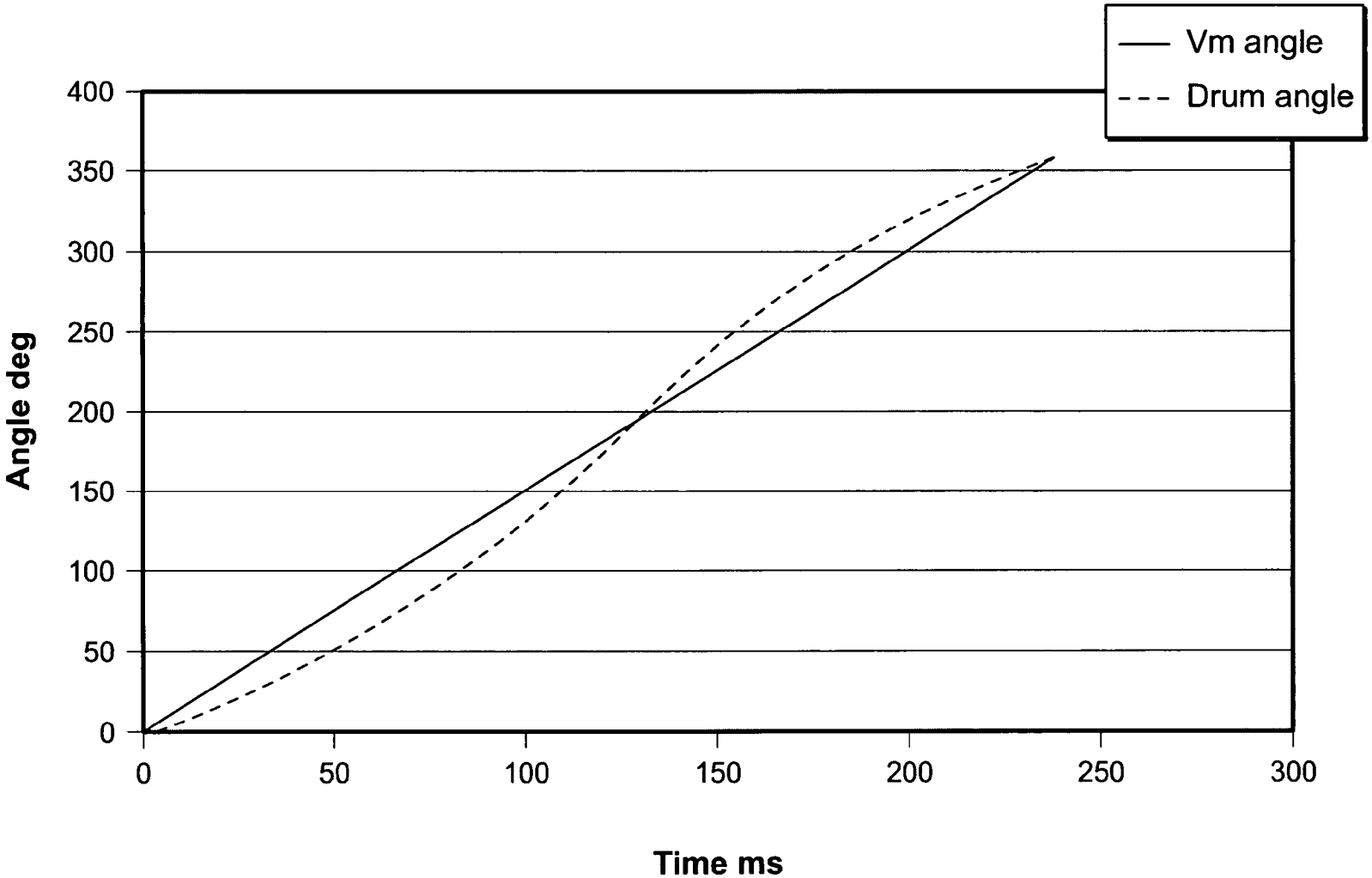
FIG. 14 shows a position profile for the velocity profile of FIG. 13.

In FIG. 13 there is illustrated yet another exemplary velocity profile for a gripper drum 20 using one gripper 22 to feed every other pocket 32. In this embodiment of the present invention, the drum 20 is operated to run at an average speed of 250 rpm. As shown in FIG. 13, the drum 20 is accelerated for 180 degrees and decelerated for 180 degrees. FIG. 14 shows a related positional angle over the 240 ms needed for one rotation of the drum 20.

Figure 15:
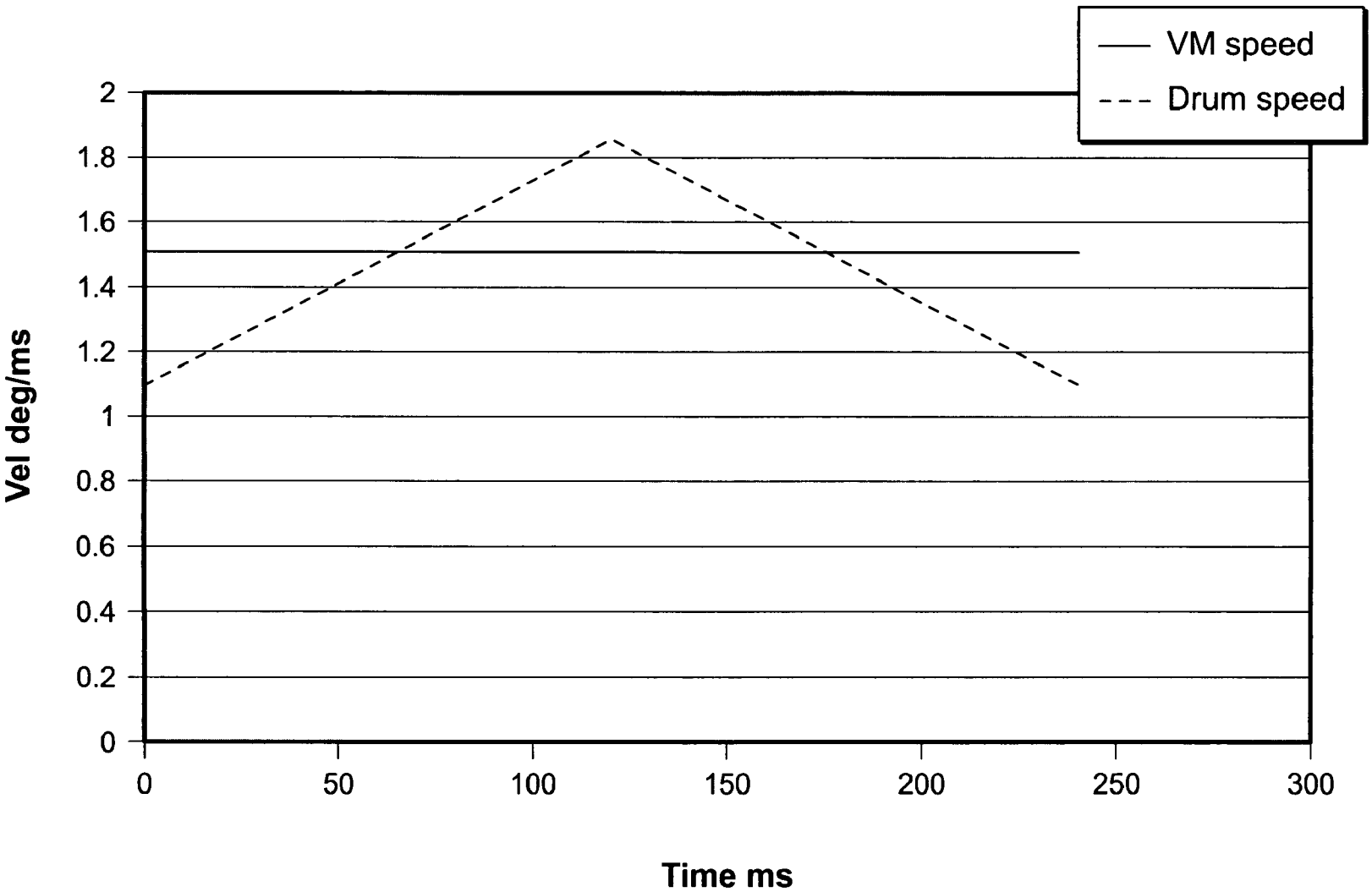
FIG. 15 shows another exemplary velocity profile for a gripper drum using one gripper feeding every other pocket at a higher speed.
Figure 16:
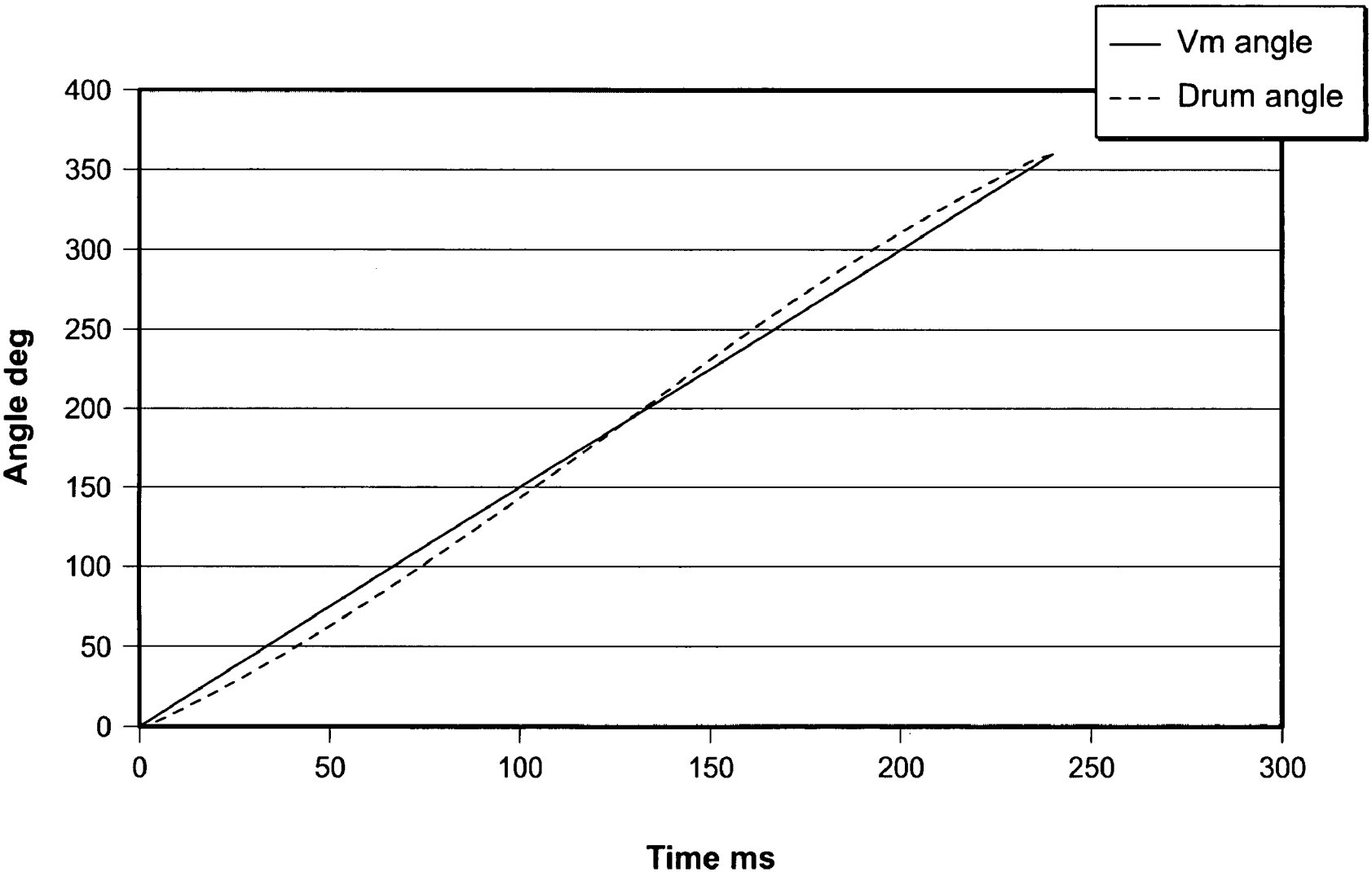
FIG. 16 shows a position profile for the velocity profile of FIG. 15.

FIGS. 15 and 16 show velocity and position profiles that are similar to those of FIGS. 13 and 14 respectively, but with a speed reduction for the drum 20 of 25%, rather than 50%.

Figure 17:
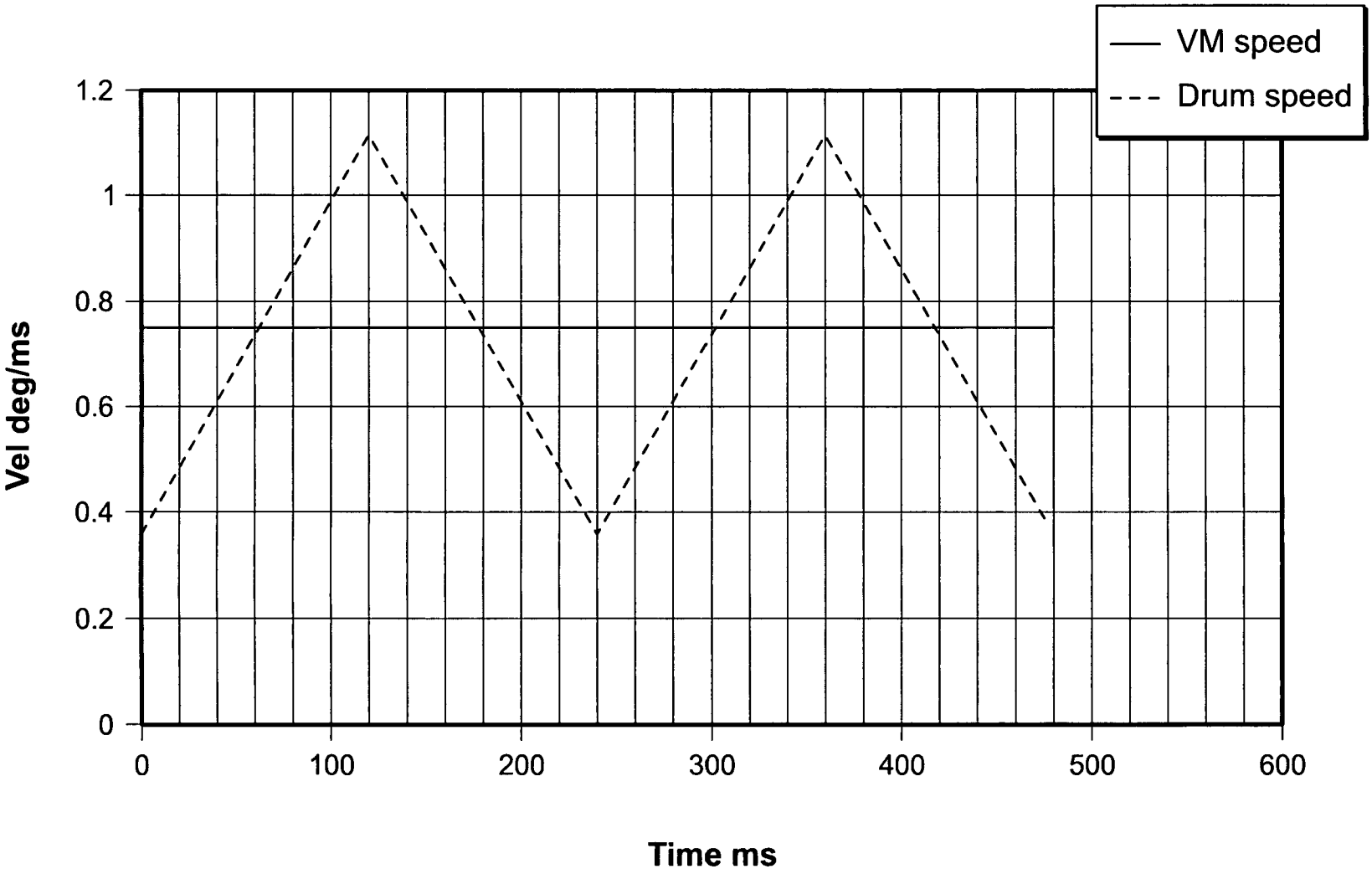
FIGS. 17 & 18 show exemplary velocity profiles for two grippers feeding every pocket.

FIG. 17 shows a velocity profile for two grippers 22,24 feeding each pocket 32 of the conveyor 30, at 15,000 pph. Each alternating 90 degrees of rotation of the drum 20 produces either an acceleration phase or a deceleration phase. This profile can correspond to the schematic shown in FIG. 7. The starting point for the acceleration or deceleration can also be shifted to correspond to the gripping of a printing product.

Figure 18:
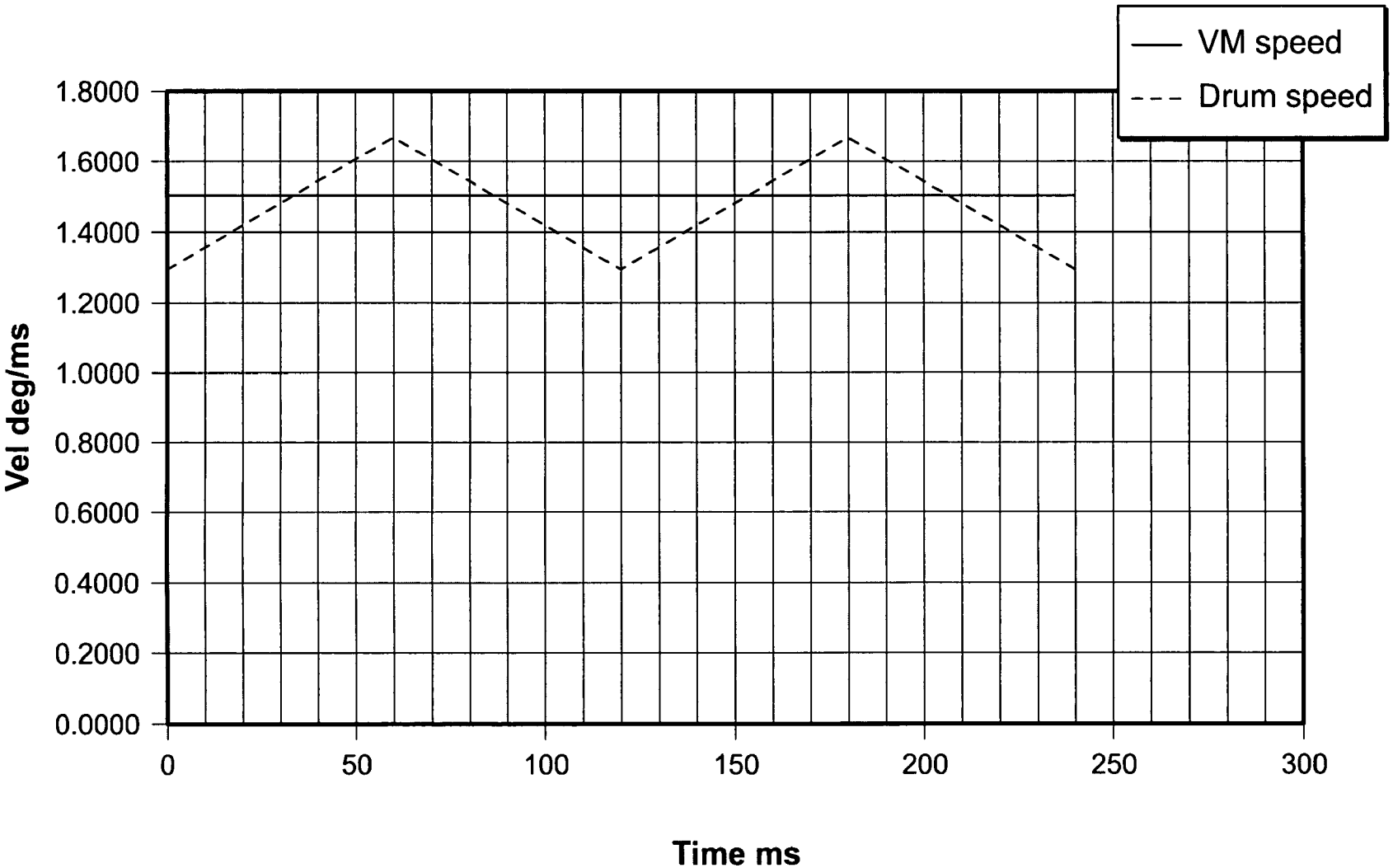

In FIG. 18 there is illustrated a profile similar to the profile of FIG. 17, however, the speed of product delivery is increased to a speed of 30,000 pph so that the acceleration and deceleration phases alternate every 60 ms.

In the preceding specification, the invention has been described with reference to specific exemplary embodiments and examples thereof. It will, however, be evident that various modifications and changes may be made thereto without departing from the broader spirit and scope of the invention as set forth in the claims that follow. The specification and drawings are accordingly to be regarded in an illustrative manner rather than a restrictive sense.

What is claimed is:

1. A method for transferring printed products comprising the steps of:

pulling a printed product from a stack using a rotating drum having grippers, the rotating drum rotating at a first preselected speed;

accelerating the rotating drum together with the grippers using a servo motor after pulling the printed product from the stack while the gripper grips the printed product;

releasing the printed product from the rotating drum having grippers to a collecting conveyor, the rotating drum rotating at a second preselected speed greater than the first preselected speed; and controlling the servo motor and the collecting conveyor via a controller.

2. The method of claim 1 wherein the servo motor controls the drum together with the grippers during a full revolution comprising the steps of:

accelerating the drum together with the grippers for a preselected period of rotation to a maximum speed, maintaining the drum together with the grippers at the maximum speed for a preselected period of rotation and then decelerating the drum together with the grippers for a preselected period of rotation to a minimum speed.

3. The method of claim 1 comprising the further step of decelerating the rotating drum having grippers to the first preselected speed after release of the printed product.

4. The method of claim 3 wherein the rotating drum having grippers is operated at the first preselected speed for a first fixed period, and at the second preselected speed for a second fixed period, and is operated at alternating acceleration and deceleration phases between the first and second fixed periods.

5. The method of claim 1 wherein the servo motor controls the drum together with the grippers during a full revolution comprising the steps of:

accelerating the drum together with the grippers for a preselected period of rotation to a maximum speed and then decelerating the drum together with the grippers for a preselected period of rotation to a minimum speed.

6. The method of claim 1 wherein the servo motor controls the drum together with the grippers during a half revolution comprising the steps of:

accelerating the drum together with the grippers from zero velocity to a maximum velocity and then decelerating the drum together with the grippers to the velocity of zero.

7. The method of claim 1 wherein the servo motor controls the drum together with the grippers during a half revolution comprising the steps of:

accelerating the drum together with the grippers from a constant velocity to a maximum velocity and then decelerating the drum together with the grippers from the maximum velocity to the constant velocity.

8. The method of claim 1 wherein the servo motor controls the drum together with the grippers comprising the steps of:

accelerating the drum together with the grippers from a constant velocity to a maximum velocity and then decelerating the drum together with the grippers from the maximum velocity to the constant velocity wherein each acceleration and deceleration phase equals a time period of about 120 ms.

9. The method of claim 1 wherein the servo motor controls the drum together with the grippers comprising the steps of:

accelerating the drum together with the grippers from a constant velocity to a maximum velocity and then decelerating the drum together with the grippers from the maximum velocity to the constant velocity wherein each acceleration and deceleration phase equals a time period of about 60 ms.

10. The method of claim 1 wherein the collecting conveyor is a pocket conveyor having a plurality of pockets.

11. The method of claim 1 comprising the further step of delivering a second printed product from a second stack to the collecting conveyor using a second rotating drum having grippers.

12. The method of claim 11 wherein the collecting conveyor is a collecting conveyor having a plurality of sequential pockets and the rotating drum having grippers delivers a printed product to every other sequential pocket and the second rotating drum having grippers delivers a second printed product to every other sequential pocket such that the rotating drum having grippers and the second rotating drum having grippers alternate delivering printed products and second printed products to sequential pockets.

13. A device for feeding printed products from a stack to a collecting conveyor, the device comprising:

a) a rotating drum having grippers for pulling a printed product from a the stack at a first location at a first preselected speed and releasing the printed product to the collecting conveyor at a second location at a second preselected speed;

b) a variable-speed drive for driving the rotating drum having grippers so as to accelerate the rotating drum having grippers between the first and second locations while the gripper grips the printed product the rotating drum rotating at the second preselected speed greater than the first preselected speed; and c) a controller controlling the variable-speed drive and the collecting conveyor.

14. The device of claim 13 wherein the variable-speed drive operates to decelerate the rotating drum having grippers on return to the first location from the second location.

15. A method for transferring printed products comprising the steps of:

pulling a printed product from a stack using a rotating drum having grippers, the rotating drum rotating at a first preselected speed;

accelerating the rotating drum together with the grippers using a servo motor after pulling the printed product from the stack to a maximum speed while the gripper grips the printed product;

releasing the printed product from the rotating drum having grippers to a collecting conveyor while the rotating drum having grippers is rotating at a second preselected speed greater than the first preselected speed;

decelerating the rotating drum together with the grippers using the servo motor to the first preselected speed for pulling a next printed product from the stack; and controlling the servo motor and the collecting conveyor via a controller.

16. The method of claim 15 wherein the step of pulling a printed product from a stack is carried out by operating the rotating drum together with the grippers to rotate at varying speeds of rotation between minimum and maximum speeds of rotation.

17. The method of claim 16 wherein the rotating drum together with the grippers is operated in alternating acceleration and deceleration phases between the minimum and maximum speeds of rotation, each phase being for a preselected period of rotation.

18. The method of claim 17 wherein the rotating drum together with the grippers is operated such that there are four preselected periods of rotation per each 360 degree revolution.

19. The method of claim 17 wherein the rotating drum together with the grippers is operated such that there are two preselected periods of rotation per each 360 degree revolution.

20. The method of claim 15 comprising the further step of delivering a second printed product from a second stack to the collecting conveyor using a second rotating drum having grippers.

21. The method of claim 20 wherein the collecting conveyor is a collecting conveyor having a plurality of sequential pockets and the rotating drum having grippers delivers a printed product to every other sequential pocket and the second rotating drum having grippers delivers a second printed product to every other sequential pocket such that the rotating drum having grippers and the second rotating drum having grippers alternate delivering printed products and second printed products to sequential pockets.

22. The method of claim 15 wherein the collecting conveyor is a pocket conveyor having a plurality of pockets.

23. A method for transferring printed products between a stack and a collecting conveyor, comprising the steps of:

pulling a printed product from the stack using a rotating drum having grippers, the rotating drum rotating at a first preselected speed;

accelerating the rotating drum together with the grippers using a servo motor after pulling the printed product from the stack to a maximum speed while the gripper grips the printed product;

releasing the printed product from the rotating drum having grippers to the collecting conveyor, while the rotating drum having grippers is rotating at a second preselected speed greater than the first preselected speed;

decelerating the rotating drum together with the grippers using the servo motor to the first preselected speed for pulling a next printed product from the stack;

operating the rotating drum having grippers at an average speed over acceleration and deceleration, between pulling the printed product from the stack and pulling the next printed product from the stack, such that release of each printed product is in a preselected synchronization to operation of the collecting conveyor; and controlling the servo motor and the collecting conveyor via a controller.

24. The method of claim 23 wherein the step of pulling a printed product from the stack is carried out by operating the rotating drum together with the grippers to rotate at varying speeds of rotation between minimum and maximum speeds of rotation.

* * * * *